US005520158A

United States Patent [19]

Williamson

[11] Patent Number: 5,520,158

[45] Date of Patent: May 28, 1996

[54] MAGNETIC FIELD FUEL TREATMENT DEVICE

[75] Inventor: David G. Williamson, Yate, England

[73] Assignee: Gasmaster International, Inc., San Diego, Calif.

[21] Appl. No.: 371,790

[22] Filed: Jan. 12, 1995

[51] Int. Cl.[6] ..... F16C 1/04

[52] U.S. Cl. ..... 123/538

[58] Field of Search ..... 123/536, 537, 123/538, 539; 210/222, 695; 335/219; 431/356, 3, 1

[56] References Cited

U.S. PATENT DOCUMENTS

| | | | |
|---|---|---|---|
| 3,349,354 | 10/1967 | Miyata | 123/536 |
| 3,402,820 | 9/1968 | Lohmann | 210/222 |
| 3,830,621 | 8/1974 | Miller | 123/539 |
| 4,414,951 | 11/1983 | Saneto | 123/536 |
| 4,461,262 | 7/1984 | Chow | 123/539 |
| 4,711,271 | 12/1987 | Weisenbarger et al. | 123/538 |
| 5,271,369 | 12/1993 | Melendrez | 123/538 |
| 5,331,807 | 7/1994 | Hricak | 123/539 |
| 5,348,050 | 9/1994 | Ashton | 210/222 |

*Primary Examiner*—Marguerite Macy
*Attorney, Agent, or Firm*—Brown, Martin, Haller & McClain

[57] ABSTRACT

A simple and efficient straight in-line fuel pretreatment device is described, utilizing dwell time, magnet orientation and magnetic field strength to enhance the combustion properties of all types of hydrocarbon fuels, both liquid and gaseous fuels. A plurality of pairs of magnets, more with facing opposite poles and fewer with facing like poles, are aligned within the fuel conduit to a burner. The resulting magnetic field strength must be at least 500 gauss, preferably 500–1000 gauss, with dwell times in the range of about 0.1–1.0 second. Also disclosed is a method for pretreatment of combustion fuel which comprises passing a quantity of the combustion fuel through such magnetic field for a dwell time sufficient to enhance the combustion properties of the fuel. The pretreatment device can be made in standardized sizes for various types of commercial, light industrial and residential burners and combustion units. The device and method allow burners to become and stay cleaned of carbon deposits and therefore to operate at high efficiency.

20 Claims, 2 Drawing Sheets

MAGNETIC FIELD FUEL TREATMENT DEVICE

BACKGROUND OF THE INVENTION

1. Field of the Invention

The invention herein relates to the pretreatment of fuel being supplied to a furnace or boiler. More particularly it relates to fuel pretreatment devices to enhance combustion properties of the fuel.

2. Description of the Prior Art

Many different approaches have been taken to improving the efficiency of burners for commercial, industrial and residential furnaces and boilers. While some approaches have dealt with modifications and improvements to the equipment itself, others have concentrated on improving the combustion properties of the various fuels used. One technique used to improve the combustion properties of fuel is ionization. Commercial fuel ionizers for both stationary furnaces and boilers and for mobile combustion devices such as vehicle engines have been on the market for some years. Ionization of the fuel is generally imparted by either permanent magnets or electromagnets.

All such previous devices, however, have been complex and use intricate flow paths for the fuel. Prior efforts to design and use straight, in-line ionizers have been unsuccessful, in that they have been unable to produce any significant improvement in the combustibility of the fuels on which they are used. The complex units are effective, but are quite expensive and therefore their use is discouraged.

It would therefore be advantageous to have a simple, straight, in-line device which will enhance the combustion properties of common fuels.

SUMMARY OF THE INVENTION

The present invention utilizes a unique combination of dwell time, magnet alignment and magnetic field strength to provide a simple and efficient fuel enhancement device which can be used in-line immediately before a burner. The device works on all types of hydrocarbon fuels, both liquid and gaseous fuels, and provides for improved combustibility, leading either to lower fuel consumption for a given burner rating or to greater burner thermal output for a given quantity of fuel burned.

In one principal aspect, the invention is a device for pretreatment of combustion fuel which comprises an elongated hollow conduit, communicating with a combustion chamber in which the fuel is to be burned, for movement of the fuel through the conduit from a supply source to the combustion chamber; an elongated hollow tube enclosing a portion of the conduit, the tube comprising a wall having two interior surface segments disposed opposite to each other across the conduit segment; the facing segments having associated therewith a plurality of opposed pairs of magnets, a majority of the pairs having facing poles of opposite polarity and the remainder having poles of like polarity; a magnetic field of varying flux paths created by the plurality of pairs of magnets and disposed therebetween, the magnetic field existing generally laterally across and longitudinally along the conduit portion and having a field strength of at least 500 gauss: and the conduit portion having an internal volume sufficient to retain a unit quantity of the moving fuel within the magnetic field for a time sufficient to enhance the combustibility of the unit quantity of fuel in the combustion chamber. Magnetic field strengths will preferably be on the order of 500–1000 gauss or more and dwell times of in the range of about 0.1–1.0 second, typically about 0.4–0.5 second. Fuels used may include all conventional hydrocarbon fuels, including methane, propane, butane, natural gas, town gas, and producer gas.

In another principal aspect, the invention is a method for pretreatment of combustion fuel which comprises passing a quantity of the combustion fuel through an elongated hollow conduit, communicating with a combustion chamber in which the fuel is to be burned, from a supply source to the combustion chamber; exposing the quantity of fuel within the conduit to a magnetic field of varying flux paths, the magnetic field being created by a plurality of pairs of magnets and disposed therebetween, the plurality of pairs of magnets being disposed on the interior of the conduit, a majority of the pairs having facing poles of opposite polarity and the remainder having poles of like polarity, with the magnetic field existing generally laterally across and longitudinally along the conduit and having a field strength of at least 500 gauss: and retaining the quantity of fuel within the field in the conduit for a time sufficient to enhance the combustibility of the quantity of fuel in the combustion chamber. Preferably the device will be disposed upstream of but sufficiently close to the burner that the fuel will take not more than five seconds to reach the burner for combustion after having exited from the magnetic field, in order to preserve the full enhancement effect of being subjected to the magnetic field.

DETAILED DESCRIPTION AND PREFERRED EMBODIMENTS

Figure 1:
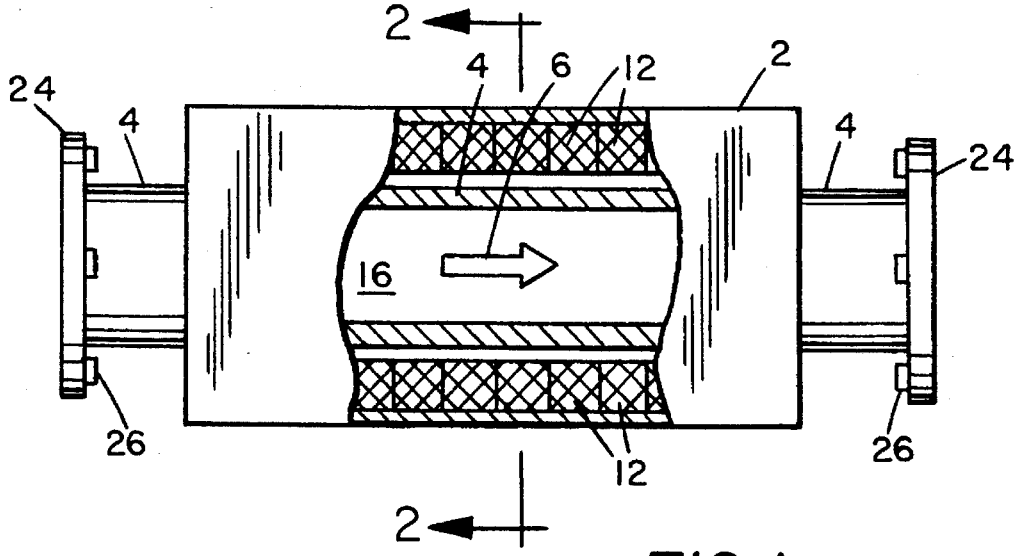
FIG. 1 is a side-elevation view, partially cut away, illustrating the principal parts of the device.

The device of the present invention is best understood by reference to the drawings. The central part of the device is within a housing 2 which has a generally rectangular cross-section. Centrally located within the housing 2 is a pipe or conduit 4 through which the fuel flows as indicated by arrows 6.

The housing 2 has at least two interior surfaces designated 8*a* and 8*b*, which are disposed opposite each other across the interior 10 of housing 2. Attached to interior surfaces 8*a* and 8*b* are a plurality of pairs of magnets 12. Each pair of magnets 12 is positioned such that they have poles facing each other and create a magnetic field across the interior 16 of the conduit 4.

Figure 2:
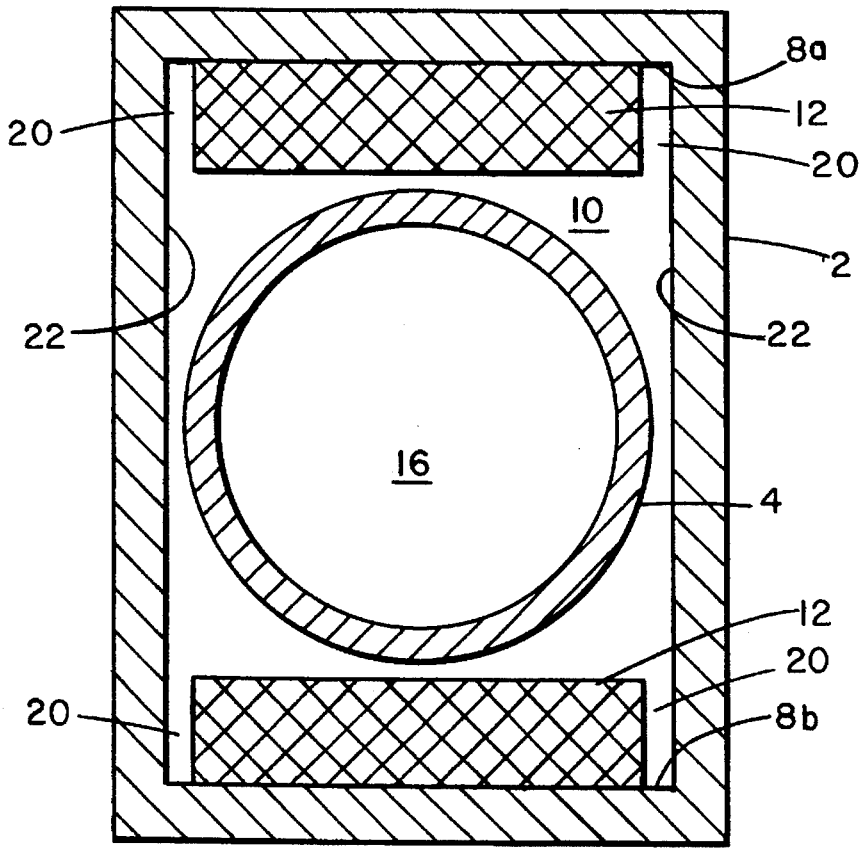
FIG. 2 is a cross-sectional view taken on line 2—2 of FIG. 1.

The plurality of pairs of magnets 12 are attached to the surfaces 8*a* and 8*b* and extend longitudinally for substantially the entire length of the conduit 4 portion within the housing 2. Each magnet preferably also extends laterally almost all the way across the respective surface 8*a* or 8*b* as illustrated in FIG. 2. However, each magnet 12 must be positioned so that there is a clearance space 20 along its sides and the interior of the adjacent side 22 of the housing 2 so that no portion of a magnet 12 touches any other surface of the housing 2 other than the surfaces 8*a* or 8*b*. The presence of the gap 20 is important because if the magnets touch other surfaces of the housing 2 the field strength will be significantly degraded. The quantity of fuel passing through the device as indicated by large arrows 6 therefore is subjected to the magnetic field for the entire length of the device.

Figure 3:
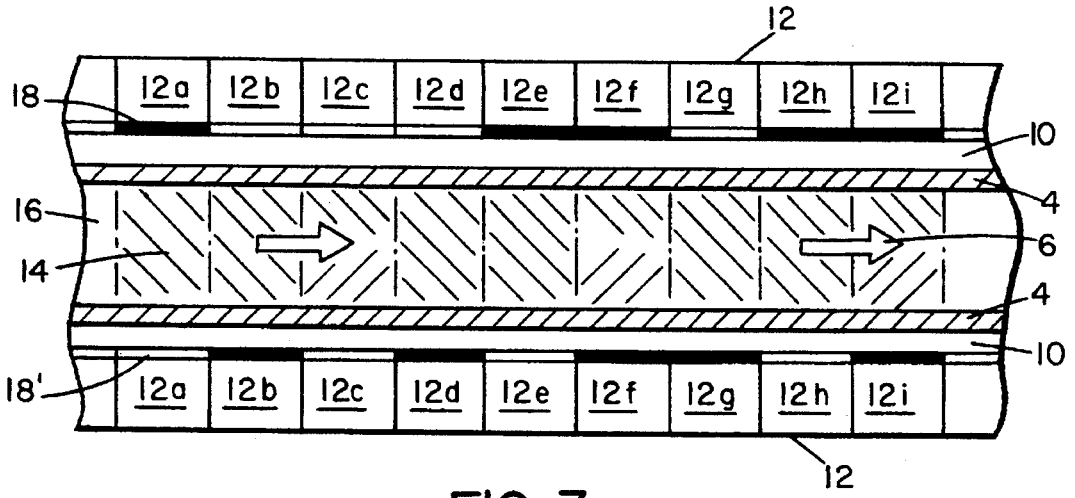
FIG. 3 is a schematic representation of a typical magnet alignment and resulting magnetic field within the device.

The orientation of the magnets 12 is illustrated in FIG. 3. The majority of pairs will have their opposite poles 18 and 18' facing each other, while a substantial minority of pairs will have their like poles 18 and 18' facing each other. In this schematic the type of polarity of each facing pole 18 or 18' is indicated graphically by a shaded or open bar at the end of the magnet 12. Those pairs (illustrated by 12*a*, 12*b*, 12*d*, 12*e*, 12*g* and 12*h*) which have opposite poles facing will have one type of magnetic flux pattern created between the faces, while the other pairs (illustrated by 12*c*, 12*f* and 12*i*) with like poles facing will create a type of different flux pattern, all represented graphically by lines 14. It will be understood that the flux patterns will not be precisely aligned as the lines 14 suggest but will vary throughout the interior 16 of the conduit 4. For the purposes of this invention, however, the important point is that a unit volume of fuel passing axially through the conduit 4 will thus encounter varying magnetic fields over the length of the conduit. Preferably about two-thirds of the magnet pairs will have their opposite poles facing each other, with the remaining one-third having their like poles facing each other, but other ratios are also acceptable.

While it is possible for a few pairs of large magnets to create a suitable field throughout the entire length of the unit, it is more practical to have substantial number of pairs of magnets, each having a length of a few inches, since such magnet sizes are readily available commercially.

At each end of the housing 2 the conduit 4 extends out through the housing to flanges 24 respectively, which in turn are connected to the fuel piping system as by bolts 26 in a conventional manner. Since the enhancement effect of the magnetic field on the fuel tends to dissipate rapidly, it is preferred that the unit be connected to the conduit leading into burner of the furnace or boiler where the fuel is to be combusted by a relatively short length of conduit, such that the magnetically treated fuel reaches the combustion chamber within no more than five seconds from the time that it exits from the magnetic field.

In order for the device to operate properly, the conduit 4 must be longitudinally straight and made of a nonmagnetic material, so that the field passing through the conduit 4 and the fuel will not be distorted or degraded. Various nonmagnetic materials such as copper or aluminum may be used for the conduit 4, although preferably the conduit will be made of a nonmetallic stainless steel. The nonmagnetic stainless steels include those of austenitic composition (unless heavily cold worked), and can readily be distinguished from the highly magnetic chromium-carbon and low-alloy steels by a magnet test alone or in combination with known chemical tests. See Lyman (ed.), *Metals Handbook*, vol. 1 (8th edn.: 1961) , p. 430. Typical nonmagnetic stainless steels include the 18-8 steels such as AISI (American Iron and Steel Institute) grades 302 and 303. Also suitable are the nonmagnetic copper-nickel-zinc alloys known as nickel-silver; see Lyman, supra, pp. 409 and 961. (Conduit 4 is shown as stippled in FIG. 3, but that is for identification in the schematic diagram of FIG. 3 and is not intended to indicate a particular material.)

The wall thickness of the conduit 4 will depend on the fluid pressure and volumetric flow rate of the fuel, and whether the fuel is in liquid or gaseous form. Normally, wall thicknesses of standard dimensions determined by well known fluid flow and pressure criteria will be entirely satisfactory. Such standards and the appropriate calculations for any given flow are widely described in engineering and fluid dynamics texts, such as Perry et al., *Chemical Engineers Handbook* (5th Edn.: 1973), Section 6.

The housing 2 will normally be made of a standard structural ferrite steel or any other suitable material of sufficient strength and durability, and will preferably have a straight elongated rectangular form as illustrated in the drawings. Most preferred is a four-sided structure as shown in the drawings, although the cross-section may be hexagonal or the sides having surfaces 22 may be curved if desired. It is important to this invention, however, that the housing's surfaces 8*a* and 8*b* must be substantially straight and disposed directly opposite each other across the conduit 4.

The magnets 12 may be any conventional ceramic or ferromagnetic materials that will produce the required field strength of at least 500 gauss. Preferably the field strength will be in the range of 500–1000 gauss. While 1000 gauss is mentioned as a preferred upper value, it will be understood that the actual upper range value will be dependent upon the nature of the magnetic materials used. Magnetic materials which can produce higher field strengths will be quite suitable from a technical point of view, but may not be economical. Many suitable magnetic materials are well known and are widely described in the literature. A typical example of a source of extensive information on the magnetic materials, including both metals and ceramics, is McCaig et al., *Permanent Magnets in Theory and Practice* (2d Edn.: 1987), Chapter 4 and Appendix 2. Particularly preferred magnets for the present invention are those commercially available from Crucible Magnetics Company of Elizabethtown, Ky. as Model No. BSLF 00340 under the brand name of Aniso Ferrite Block; equivalent types are available from other manufacturers.

The dimensions of the device will depend on the volume of fuel per unit time that is to be fed to the burner, furnace or other combustion chamber. Typically for most commercial, light industrial and home burners the fuel conduit 4 will be a pipe having a nominal diameter of ⅜" to 6 inches (9.5–152 mm). Typical examples of the flow capacity and heat content of the fuels to be supplied for a number of different pipe sizes within that range are shown in the Table below. It has been found that for propane as a fuel, the typical length of the conduit and magnetic field of a "single" device is 4 feet (1.22 m), and such units are designated by the abbreviation "SGL" in the Table below. For larger quantities of fuel, it is most convenient to have a "double" unit, which will be a unit in which the conduit and magnetic field extend for twice the length of that in the single unit. These are designated "DBL" in the Table below. The typical length for a double unit for propane is 8 feet (2.44 m).

TABLE

| Pipe Size | | Unit | Rating | Range | Steam |
|---|---|---|---|---|---|
| Inches | mm OD | Type | Therms/hr | KWH | Lbs/hr |
| | | Gaseous Fuel | | | |
| ½ | 22 | SGL | ≦0.77 | ≦22.5 | NA |
| ½ | 22 | DBL | >0.77 | >22.5 | NA |
| ¾ | 27 | SGL | ≦1.66 | ≦50 | NA |
| ¾ | 27 | DBL | >1.66 | >50 | NA |
| 1 | 34 | SGL | ≦3.36 | ≦100 | ≦350 |

TABLE-continued

| Pipe Size | | Unit | Rating | Range | Steam |
|---|---|---|---|---|---|
| Inches | mm OD | Type | Therms/hr | KWH | Lbs/hr |
| 1 | 34 | DBL | >3.36 | >100 | >350 |
| 1¼ | 42 | SGL | ≦6.66 | ≦195 | ≦680 |
| 1¼ | 42 | DBL | >6.66 | >195 | >680 |
| 1½ | 48 | SGL | ≦11 | ≦330 | ≦1150 |
| 1½ | 48 | DBL | >11 | >330 | >1150 |
| 2 | 60 | SGL | ≦27 | ≦790 | ≦2800 |
| 2 | 60 | DBL | >27 | >790 | >2800 |
| 2½ | 76 | SGL | ≦60 | ≦1760 | ≦6200 |
| 2½ | 76 | DBL | >60 | >1760 | >6200 |
| 3 | 89 | SGL | ≦100 | ≦3000 | ≦10500 |
| 3 | 89 | DBL | >100 | >3000 | >10500 |
| 4 | 114 | SGL | ≦240 | ≦7000 | ≦25000 |
| 4 | 114 | DBL | >240 | >7000 | >25000 |
| 6 | 165 | SGL | ≦670 | ≦20000 | ≦70000 |
| 6 | 165 | DBL | >670 | >20000 | >70000 |
| | | Heavy Oil Fuel | | | |
| ½ | 15 | SGL | ≦125 | ≦3670 | ≦13000 |
| ½ | 15 | DBL | >125 | >3670 | >13000 |
| ¾ | 22 | SGL | ≦340 | ≦9900 | ≦35000 |
| ¾ | 22 | DBL | >340 | >9900 | >35000 |
| 1 | 28 | SGL | ≦740 | ≦22000 | ≦76000 |
| 1 | 28 | DBL | >740 | >22000 | >76000 |
| | | Light Oil Fuel | | | |
| ⅜ | 10 | SGL | ≦55 | ≦1650 | ≦5700 |
| ⅜ | 10 | DBL | >55 | >1650 | >5700 |
| ½ | 15 | SGL | ≦115 | ≦3350 | ≦1800 |
| ½ | 15 | DBL | >115 | >3350 | >11800 |
| ¾ | 22 | SGL | ≦310 | ≦9000 | ≦32000 |
| ¾ | 22 | DBL | >310 | >9000 | >32000 |
| 1 | 28 | SGL | ≦675 | ≦20000 | ≦70000 |
| 1 | 28 | DBL | >675 | >20000 | >70000 |

Figure 4:
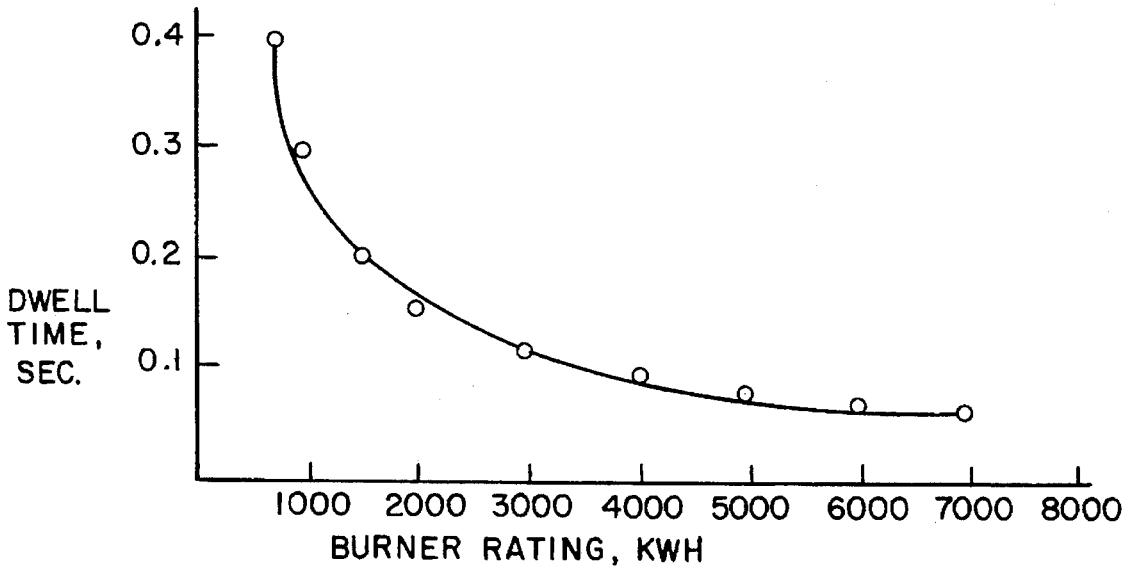
FIG. 4 is a graphical representation of the relationship between dwell time and burner rating for a device of the present invention operating on propane fuel and used with 1000–7000 KWH burners.

A critical feature of the present invention is that the device must be of sufficient length and volume that the moving fuel is retained within the magnetic field for a sufficient retention time or "dwell time" to cause a significant enhancement in the combustion properties of the fuel. The actual amount of dwell time for any particular fuel will depend in large measure on the fuel itself. Different fuels have different heat contents, having heating values in the range of about 1000 BTU/ft$^3$ (10 KWH/m$^3$) for natural gas, 2500 BTU/ft$^3$ (26 KWH/m$^3$) for propane and 4000 BTU/ft$^3$ (41 KWH/m$^3$) for pentane; see Perry et al., supra, Section 9 and Johnson et al., *Fuels and Combustion Handbook*, Chapter 7 and 9 (1950), so one can identify volumetric flow rate by the thermal content of a given fuel. Typically the volumetric flow rate will be sufficient to provide a quantity of gas or liquid fuel having a heating value of 0.50–750 therms/hr to the burner. Since a larger volume of low heating content fuel must be passed through the unit in a given period of time to provide an equivalent amount of furnace heat output as compared to a higher heating content fuel, the dwell time for the former will normally be shorter than for the latter. Taking as example, a device having a 4 ft (1.22 m) long 500 gauss magnetic field and a 6 in (15 cm) diameter conduit treating propane fuel used to run a 7000 KWH burner at 240 therm/hr heat production, from the Table above and FIG. 4, will have a dwell time in the range of about 0.1–0.5 second. Other examples for the same device but different burner ratings are illustrated in FIG. 4. Those skilled in the art, from these examples and well known thermal data for fuels, can readily determine what the equivalent anticipated dwell time is for any other specified fuel. Dwell time will also be a function of the strength of the magnetic field, which will as noted be a minimum of 500 gauss. The higher magnetic field strengths will provide equivalent enhancement of the combustion properties of the fuel over a shorter dwell time or, for an equivalent dwell time will provide greater combustion properties enhancement. Against this of course must be balanced the added cost of the stronger magnets. Those skilled in the art will be readily able to determine the optimum field strengths for any given fuel and furnace, by comparing the value of the combustion enhancement with the added equipment cost, particularly the cost of magnets.

A particular advantage of the present device is its ability to condition fuel such that built-up carbon is cleaned from the burners of both oil and gas boilers to which the conditioned fuel is fed. This will result in a substantial improvement in the burners' efficiency and thus have a positive effect on fuel consumption and costs. The advantage will of course be more dramatic with those boiler/burner systems which are initially "dirty" as compared to those which are "cleaner." As an example, a 4" (114 mm) single 4' (1.21 m) length device of the present invention was fitted into the fuel supply line to one of two like 30,000 lb gas fired steam boilers at a paper mill which are used on alternate weeks as the mill's main and standby boilers. Both boilers started the test after recent major servicing. After a period of one year the boiler equipped with the device of this invention was operating at fuel savings of over 10% as compared to its non-equipped twin. Further, it was observed that the non-equipped burner was showing a yellowish flame, while the equipped burner was showing a bluish flame, thus indicating the presence of significant carbonization in the non-equipped burner which was absent from the equipped burner.

While the mechanism of enhancement has not been determined with particularity, it is believed that the varying magnetic field causes temporary ionization of at least part of the fuel, such that the fuel takes on a positive charge for a period of up to one minute. The positively charged fuel reaching the burner more readily combines with the oxygen in the air feed to the combustion chamber, so that more rapid and thorough combustion of the carbonaceous fuel takes place.

The fuel to be treated by the present device may be any typical hydrocarbon fuel, whether liquid or gas. Typical liquid heating oils include Nos. 1 and 2 oils and various industrial fuel oils, while the common gas fuels include any of a variety of different natural gases or methane, propane, butane, producer gas, town gas, reformed gas, coal gas and the like. Many suitable examples are well described in the literature.

It will be evident that there are numerous embodiments of this invention which, while not specifically described above, are clearly within the scope and spirit of the invention. Therefore the above description is intended to be exemplary only, and the scope of the invention is to be determined solely by the appended claims.

I claim:

1. A device for pretreatment of combustion fuel which comprises:

an elongated hollow conduit, communicating with a combustion chamber in which said fuel is to be burned, for movement of said fuel through said conduit from a supply source to said combustion chamber;

an elongated hollow tube enclosing a portion of said conduit, said tube comprising a wall having two interior surface segments disposed opposite to each other across said conduit segment;

said facing segments having associated therewith a plurality of opposed abutting pairs of magnets disposed longitudinally, a majority of said pairs having facing poles of opposite polarity and the remainder having poles of like polarity;

a magnetic field of varying flux paths created by said plurality of pairs of magnets and disposed therebetween, said magnetic field existing generally laterally across and longitudinally along said conduit portion and having a field strength of at least 500 gauss: and said conduit portion having an internal volume sufficient to retain a unit quantity of said moving fuel within said magnetic field for a time sufficient to enhance the combustibility of said unit quantity of fuel in said combustion chamber.

2. A device as in claim 1 wherein said conduit portion and said enclosing tube are substantially straight.

3. A device as in claim 1 wherein said conduit portion and said enclosing tube are positioned substantially adjacent said combustion chamber such that fuel passing through said magnetic field and said conduit reaches said combustion chamber not more than five seconds after it exits from said magnetic field.

4. A device as in claim 1 wherein approximately two-thirds of said magnet pairs have facing poles of opposite polarity.

5. A device as in claim 1 wherein said internal volume of said conduit portion is sufficient for effective exposure of 0.50 to 750 therms/hour of fuel to said magnetic field.

6. A device as in claim 1 wherein said conduit is a conduit for liquid fuel.

7. A device as in claim 1 wherein said conduit is a conduit for gaseous fuel.

8. A device as in claim 1 wherein the cross sectional diameter of said conduit portion is in the range of 0.25–6.0 inches.

9. A device as in claim 1 wherein said magnetic field strength is in the range of 500–1000 gauss.

10. A device as in claim 1 having a volume sufficient to provide a dwell time in the range of about 0.1–1.0 second for flow rate of said fuel through said magnetic field.

11. A device as in claim 10 having a volume sufficient to provide a dwell time on the order of about 0.4–0.5 second for flow rate of said fuel through said magnetic field.

12. A method for pretreatment of combustion fuel which comprises:

passing a quantity of said combustion fuel through an elongated hollow conduit, communicating with a combustion chamber in which said fuel is to be burned, from a supply source to said combustion chamber; and exposing said quantity of fuel within said conduit to a magnetic field of varying flux paths, said magnetic field being created by a plurality of abutting pairs of magnets and disposed therebetween, said plurality of pairs of magnets being disposed longitudinally on the interior of said conduit, a majority of said pairs having facing poles of opposite polarity and the remainder having poles of like polarity, with said magnetic field existing generally laterally across and longitudinally along said conduit and having a field strength of at least 500 gauss: and retaining said quantity of fuel within said field in said conduit for a time sufficient to enhance the combustibility of said quantity of fuel in said combustion chamber.

13. A method as in claim 12 wherein a unit quantity of said fuel remains in said magnetic field for a dwell time period in the range of about 0.1–1.0 second.

14. A method as in claim 13 wherein a unit quantity of said fuel remains in said magnetic field for a dwell time period on the order of about 0.4–0.5 second.

15. A method as in claim 12 further comprising passing said quantity of fuel from said conduit to said magnetic field to said combustion chamber within not more than five seconds after said quantity of fuel exits from said magnetic field.

16. A method as in claim 12 wherein said magnetic field within said conduit is formed by said plurality of magnet pairs in which approximately two-thirds of said magnet pairs have facing poles of opposite polarity.

17. A method as in claim 12 wherein said internal volume of said conduit is sufficient for effective exposure of 0.50 to 750 therms/hour of fuel to said magnetic field.

18. A method as in claim 12 wherein said fuel is a liquid fuel.

19. A method as in claim 12 wherein said fuel is a gaseous fuel.

20. A method as in claim 12 wherein said magnetic field strength is in the range of 500–1000 gauss.

* * * * *